US010329643B2

(12) United States Patent
Wilks et al.

(10) Patent No.: US 10,329,643 B2
(45) Date of Patent: Jun. 25, 2019

(54) CORRODIBLE DOWNHOLE ARTICLE

(71) Applicant: Magnesium Elektron Limited, Manchester (GB)

(72) Inventors: Timothy E. Wilks, Swinton (GB); Mark Turski, Swinton (GB)

(73) Assignee: Magnesium Elektron Limited, Manchester (GB)

( * ) Notice: Subject to any disclaimer, the term of this patent is extended or adjusted under 35 U.S.C. 154(b) by 28 days.

(21) Appl. No.: 15/699,615

(22) Filed: Sep. 8, 2017

(65) Prior Publication Data

US 2018/0010217 A1 Jan. 11, 2018

Related U.S. Application Data

(63) Continuation of application No. 14/810,759, filed on Jul. 28, 2015.

(30) Foreign Application Priority Data

Jul. 28, 2014 (GB) ..... 14133276.6

(51) Int. Cl.

| | |
|---|---|
| ***C22C 23/00*** | (2006.01) |
| ***B22D 21/04*** | (2006.01) |
| ***C22C 23/02*** | (2006.01) |
| ***C22C 23/06*** | (2006.01) |
| ***C22C 23/04*** | (2006.01) |
| ***E21B 33/12*** | (2006.01) |
| ***E21B 34/06*** | (2006.01) |
| ***B22D 21/00*** | (2006.01) |

(52) U.S. Cl.

CPC ..... *C22C 23/00* (2013.01); *B22D 21/007* (2013.01); *B22D 21/04* (2013.01); *C22C 23/02* (2013.01); *C22C 23/04* (2013.01); *C22C 23/06* (2013.01); *E21B 33/12* (2013.01); *E21B 34/063* (2013.01)

(58) Field of Classification Search

CPC ..... B22D 21/007; B22D 21/04; C22C 23/00; C22C 23/04; E21B 34/063; E21B 33/12

USPC ..... 420/414

See application file for complete search history.

(56) References Cited

U.S. PATENT DOCUMENTS

| | | | |
|---|---|---|---|
| 6,230,799 | B1 | 5/2001 | Slaughter et al. |
| 8,425,651 | B2 | 4/2013 | Xu et al. |
| 9,057,242 | B2 | 6/2015 | Mazyar et al. |
| 9,068,428 | B2 | 6/2015 | Mazyar et al. |

(Continued)

FOREIGN PATENT DOCUMENTS

| | | | |
|---|---|---|---|
| CN | 101392345 | A | 3/2009 |
| CN | 103343271 | A | 10/2013 |

(Continued)

OTHER PUBLICATIONS

NPL: Unsworth et al, A new magnesium alloy system, Light Metal Age, Aug. 1979, pp. 29-32, (Year: 1979).*

(Continued)

*Primary Examiner* — Jie Yang

(74) *Attorney, Agent, or Firm* — Abel Schillinger, LLP

(57) ABSTRACT

A corrodible downhole article includes a magnesium alloy. The magnesium alloy includes: 1-9 wt % Zn; 1-2 wt % Cu; 0.5-1.0 wt % Mn; and 0.1-5 wt % of a corrosion promoting element (e.g., Ni). The alloy can have a 0.2% proof strength of at least 150 MPa when tested using standard tensile test method ASTM B557-10.

10 Claims, 4 Drawing Sheets

(56) References Cited

U.S. PATENT DOCUMENTS

| | | | | |
|---|---|---|---|---|
| 9,139,928 | B2 | 9/2015 | Mazyar et al. | |
| 9,528,343 | B2 | 12/2016 | Jordan et al. | |
| 2002/0102179 | A1 | 8/2002 | Murai et al. | |
| 2003/0173005 | A1 | 9/2003 | Higashi et al. | |
| 2005/0279427 | A1 | 12/2005 | Park et al. | |
| 2008/0175744 | A1 | 7/2008 | Motegi et al. | |
| 2011/0048743 | A1 | 3/2011 | Stafford et al. | |
| 2011/0229365 | A1 | 9/2011 | Lyon et al. | |
| 2012/0103135 | A1 | 5/2012 | Xu et al. | |
| 2012/0156087 | A1 | 6/2012 | Kawabata et al. | |
| 2012/0247765 | A1 | 10/2012 | Agrawal et al. | |
| 2012/0318513 | A1 | 12/2012 | Mazyar et al. | |
| 2013/0029886 | A1 | 1/2013 | Mazyar et al. | |
| 2013/0047785 | A1* | 2/2013 | Xu | C22C 23/04 75/232 |
| 2013/0112429 | A1 | 5/2013 | Crews et al. | |
| 2013/0118759 | A1* | 5/2013 | Crews | E21B 29/00 166/376 |
| 2013/0133897 | A1 | 5/2013 | Baihly et al. | |
| 2013/0168257 | A1 | 7/2013 | Mazyar et al. | |
| 2014/0124216 | A1 | 5/2014 | Fripp et al. | |
| 2014/0190705 | A1 | 7/2014 | Fripp et al. | |
| 2015/0240337 | A1 | 8/2015 | Sherman et al. | |
| 2015/0299838 | A1 | 10/2015 | Doud et al. | |
| 2016/0024619 | A1 | 1/2016 | Wilks et al. | |
| 2016/0201435 | A1 | 7/2016 | Fripp et al. | |
| 2016/0230494 | A1 | 8/2016 | Fripp et al. | |
| 2016/0251934 | A1 | 9/2016 | Walton et al. | |
| 2016/0265091 | A1 | 9/2016 | Walton et al. | |
| 2018/0010217 | A1 | 1/2018 | Wilks et al. | |

FOREIGN PATENT DOCUMENTS

| | | | | |
|---|---|---|---|---|
| CN | 103602865 | A | 2/2014 | |
| CN | 103898384 | A | 4/2014 | |
| CN | 104152775 | A | 11/2014 | |
| CN | 105779796 | A | 7/2016 | |
| CN | 106086559 | A | 11/2016 | |
| EP | 0400574 | A1 | 12/1990 | |
| EP | 0470599 | A1 | 2/1998 | |
| EP | 2088217 | A | 8/2009 | |
| FR | 2296698 | A1 | 7/1976 | |
| GB | 2095288 | A | 9/1982 | |
| GB | 2529062 | A | 2/2016 | |
| JP | 09-263871 | | 7/1997 | |
| JP | H10147830 | A | 6/1998 | |
| JP | 2008-280565 | A | 11/2008 | |
| KR | 20130023707 | A | 3/2013 | |
| WO | WO9856347 | | 12/1998 | |
| WO | WO2004001087 | A1 | 12/2003 | |
| WO | WO2010038016 | A1 | 4/2010 | |
| WO | WO-2010110505 | A1 * | 9/2010 | C22C 23/04 |
| WO | WO2014/035858 | A1 | 3/2014 | |
| WO | WO2015/127174 | A1 | 8/2015 | |
| WO | WO2016032490 | A1 | 3/2016 | |

OTHER PUBLICATIONS

NPL: English On-line translation of WO 2010110505 A1, 2010 (Year: 2010).*

Search and Examination Report dated Jan. 21, 2015 for GB1413327.6.

Magnesium Elektron Test Report dated Mar. 8, 2005.

Fishery Management Plan for American Lobster Amendment 3, New England Fishery Management Council, Jul. 1989.

Emley, "Principles of Magnesium Technology" Pergamon Press, Oxford, 1966, Select pages.

Search and Examination Report dated Dec. 7, 2015 for GB1513245.9.

Partial International Search Report for PCT/GB2015/052169 dated Oct. 27, 2015.

Gonzalez, et al. "Influence of processing route on microstructure and mechanical properties of two Mg Ni Y RE alloys", Materials Characterizations, Elsevier, New York, NY, US, vol. 64, Dec. 1, 2011, pp. 53-61.

Louzguine, et al. "Influence of Ni, Cu, Zn and Al additions on Glass-Forming Ability and Mechanical Properties of Mg—Y—Mm (Mm=Mischmetal) Alloys", Materials Science Forum, vol. 350-351, Jan. 1, 2000, pp. 123-130.

King, et al., "Influence of rare earth elements and minor additions on properties and performance of magnesium-yttrium alloys in critical aerospace applications", Annual World Magnesium Conference, Proceedings, 59th, Montreal, QC, Canada, May 19-21, Jan. 1, 2002, pp. 15-21.

Song, et al. "Understanding Magnesium Corrosion—A Framework for Improved Alloy Performance", Advanced Engineering Materials, vol. 5, No. 12, Dec. 30, 2003, pp. 837-858.

Zhang, et al. "Synthesis of disintegrable metal composite for oilfield applications" Magnesium Technology (Magnesium Technology 2013—TMS 2013 Annual Meeting and Exhibition Mar. 3, 2013 to Mar. 7, 2013 San Antonio, TX), Jan. 1, 2013, pp. 299-303.

Blawert, et al. "Magnesium secondary alloys: Alloy design for magnesium alloys with improved tolerance limits against impurities", Corrosion Science, Oxford, GB, vol. 52, No. 7, Jul. 1, 2010 (Jul. 1, 2010), pp. 2452-2468.

Wang Hai-Gang, et al. "Effect of Ni on microstructures and mechanical properties of AZ1 02 magnesium alloys", Zhuzao Foundry, Shenyang Zhuzao Yanjiusuo, CN, vol. 62, No. 4, Jan. 1, 2013 (Jan. 1, 2013), pp. 315-318.

Kim, et al: "Effect of aluminum on the corrosion characteristics of Mg—4Ni—xAl alloys", Corrosion, NACe, vol. 59, No. 3, Jan. 1, 2003 (Jan. 1, 2003), pp. 228-237.

Unsworth, et al: "A new magnesium alloy system", Light Metal Age, Fellom, San Francisco, CA, US, vol. 37, No. 7-8, Jan. 1, 1979 (Jan. 1, 1979), pp. 29-32.

Geng, et al: "Enhanced age-hardening response of Mg—Zn alloys via Co additions", Scripta Materialia, Elsevier, Amsterdam, NL, vol. 64, No. 6, Mar. 1, 2011 (Mar. 1, 2011), pp. 506-509.

Zhu, et al: "Microstructure and mechanical properties of Mg6ZnCu0.6Zr (wt.%) alloys", Journal of Alloys and Compounds, Elsevier Sequoia, Lausanne, CH, vol. 509, No. 8, Dec. 22, 2010 (Dec. 22, 2010), pp. 3526-3531.

International Search Report for PCT/GB2015/052169 dated Feb. 17, 2016.

Written Opinion of the International Searching Authority for PCT/GB2015/052169 dated Feb. 17, 2016.

Shaw, "Corrosion Resistance of Magnesium Alloys," ASM Handbook vol. 13A, Corrosion: Fundamentals, Testing, and Protection, 2003, pp. 692-696.

Hanawalt, et al, "Corrosion Studies of Magnesium and its Alloys," Metals Technology, Technical Paper 1353, Oct. 1941.

Magnesium Alloys Casting Source Directory—Engineered Casting Solutions, 2006, pp. 41-43.

Rokhlin, et al. "Magnesium Alloys Containing Rare Earth Metals, Structure and Properties," Advances in Metallic Alloys Series vol. 3, 2003.

Ghali, et al. "Corrosion Resistance of Aluminum and Magnesium Alloys," Wiley Publishing, 2010, pp. 382-389.

Kim, et al. "High Mechanical Strengths of Mg—Ni—Y and Mg—Cu—Y Amorphous Alloys with Significant Supercooled Liquid Region," Materials Transactions JIM vol. 31, 1990. pp. 929-934.

Tekumalla, et al. "Mechanical Properties of Magnesium-Rare Earth Alloy Systems: A Review," Metals 2015, pp. 1-39.

U.S. Appl. No. 15/865,768, filed Jan. 9, 2018, entitled Corrodible Downhole Article, Inventor Timothy E. Wilks, et al.

U.S. Appl. No. 15/865,776, filed Jan. 9, 2018, entitled Corrodible Downhole Article, Inventor Timothy E. Wilks, et al.

Combined Search and Examination Report for GB 1712249.0 dated Jan. 30, 2018, 6 pages.

Combined Search & Examination Report for GB1700714.7, dated Jun. 15, 2017, 8 pages.

Combined Search & Examination Report for GB1700716.2, dated Jun. 15, 2017, 8 pages.

(56) References Cited

OTHER PUBLICATIONS

Saravanan et al, "Fabrication and characterization of pure magnesium-30 vol.% SICP particle composite", Material Science & Engineering A276, 2000, pp. 108-116.
International Search Report and Written Opinion for PCT/GB2018/050039, dated Mar. 29, 2018, 11 pages.
International Search Report and Written Opinion for PCT/GB2018/050038, dated Mar. 14, 2018, 14 pages.
Song et al, "Texture evolution and mechanical properties of AZ31B magnesium alloy sheets processed by repeated undirectional bending", Journal of Alloys & Compounds, 2010, pp. 475-481.
ASTM Designation B199-99, "Standard Specification for Magnesium-Alloy Permanent Mold Castings", pp. 1-6.

* cited by examiner

CORRODIBLE DOWNHOLE ARTICLE

This disclosure relates to a magnesium alloy suitable for use as a corrodible downhole article, a method for making such an alloy, an article comprising the alloy and the use of the article.

BACKGROUND

The oil and gas industries utilise a technology known as hydraulic fracturing or "fracking". This normally involves the pressurisation with water of a system of boreholes in oil and/or gas bearing rocks in order to fracture the rocks to release the oil and/or gas.

In order to achieve this pressurisation, valves may be used to separate different sections of a borehole system. These valves are referred to as downhole valves, the word downhole being used in the context of the disclosure to refer to an article that is used in a well or borehole.

One way of forming such valves involves the use of spheres of material known as fracking balls to seal off parts of a borehole. Fracking balls may be made from aluminium, magnesium, polymers or composites.

A problem with the use of fracking balls relates to how they are removed once the fracking operation has been completed in order to allow fluid to flow through the well or borehole. One way of doing this is to drill through the fracking ball. However, this type of drilling process can hamper production, as well as being expensive, difficult and therefore undesirable.

One proposed solution to this problem has been to form the fracking ball from a material that will dissolve or corrode under the conditions in the well or borehole. An issue that needs to be considered in relation to such corrodible articles is ensuring that they corrode at a rate which allows them to remain useable for the time period during which they are required to perform their function, but that allows them to corrode or dissolve afterwards.

Degradable polymers have been used in order to provide a corrodible article for use in such methods. However, these polymers do not generally have particularly high mechanical strength.

An alternative corrodible article is described in U.S. Pat. No. 8,425,651 in the name of Xu et al. This document describes a powder metal composite comprising a nanomatrix, preferably made of Al or Ni or a combination thereof, in which are dispersed a plurality of first particles, a plurality of second particles and a solid-state bond layer. The first particles comprise Mg, Al, Zn or Mn, or a combination thereof, and the second particles comprise carbon nanoparticles. The composite may be produced by forming a powder mixture of the required components and then applying temperature and pressure to the powder to sinter and deform (but not melt) the composite in order to form a powder composite. A problem with such powder metallurgical methods is that they are complicated and expensive.

A further corrodible article is described in US patent application publication no 2012/0318513 in the name of Mazyar et al. In this document, the corrodible article is described as having a corrodible core and a metallic layer covering the core. The core material is described as being a magnesium alloy. However, it appears that the combination of magnesium and one or more other materials in a form which is not an alloy is also intended to be covered by the use of the term "alloy" in Mazyar et al. For example, this document refers to alloys of magnesium with tungsten, whereas it is actually not technically feasible to form a magnesium-tungsten alloy. Similarly, Mazyar et al also mentions powders of magnesium coated with a metal oxide as being useful for forming the core, which again would not be magnesium "alloys". Thus, Mazyar et al appears to utilise the term "magnesium alloy" to mean any way in which magnesium and another metal are combined. The metallic layer is described as including aluminium or nickel.

Although casting, forging and machining are described in Mazyar et al, these are only mentioned in very general terms (e.g., method steps and heating temperatures are not stated) and the structure of the resulting materials is not described. In addition, the preferred method of forming the corrodible article is by compressing the powder into the desired shape, for example by cold compression using an isostatic press. As noted above, such powder metallurgical methods are complicated and expensive. In addition, the resulting powder composites can have poor mechanical properties.

Thus, there is a need in the oil and gas industries to provide a corrodible article which provides the desired corrosion characteristics, whilst also having improved mechanical properties, and at a lower cost than can currently be achieved. It is also advantageous for the corrodible article to have a relatively low density (for example, compared to metals in general). This disclosure seeks to ameliorate these problems and to achieve these effects.

Many features, advantages and a fuller understanding of the disclosure will be had from the accompanying drawings and the Statement of the Disclosure that follows. It should be understood that the following Statement of the Disclosure describes the subject matter of the disclosure and presents specific embodiments that should not be construed as necessary limitations of the broad invention as defined in the claims.

STATEMENT OF THE DISCLOSURE

A first aspect of this disclosure features a corrodible downhole article comprising a magnesium alloy. The magnesium alloy comprises: 1-9 wt % Zn; 1-2 wt % Cu; 0.5-1.0 wt % Mn; and 0.1-5 wt % of a corrosion promoting element.

Referring to specific features of the first aspect of the disclosure, the corrosion promoting element includes Ni.

Another feature is that the alloy can include 5-8% by weight of Zn.

In another feature the alloy includes Zn, Cu, Mn and the corrosion promoting element, wherein the remainder is magnesium and incidental impurities.

In another feature the corrodible downhole article is a downhole tool.

Another feature is that the alloy has a 0.2% proof strength of at least 150 MPa when tested using standard tensile test method ASTM B557-10.

A second aspect of the disclosure features a corrodible downhole article comprising a magnesium alloy. The magnesium alloy comprises: 4.5-7.0 wt % Zn; 1.0-2.0 wt % Cu; 0.5-1.0 wt % Mn; optionally 0.1-0.5 wt % Ca; and 2-4 wt % of a corrosion promoting element.

This alloy is particularly suitable as a corrodible downhole article for use in freshwater.

It should be appreciated that the specific features mentioned in connection with the above aspects of the present disclosure may be used in any combination and in connection with other aspects of the disclosure. For example, any of the features of the embodiments discussed below including the examples, in any combination, may apply to the aspect of the disclosure discussed above.

This disclosure relates to a magnesium alloy suitable for use as a corrodible downhole article, wherein the alloy has a corrosion rate of at least 50 mg/cm$^2$/day in 15% KCl at 93° C. and a 0.2% proof strength of at least 50 MPa when tested using standard tensile test method ASTM B557-10.

In relation to this disclosure, the term "alloy" is used to mean a composition made by mixing and fusing two or more metallic elements by melting them together, mixing and re-solidifying them.

The magnesium alloy particularly comprises a corrosion promoting element selected from the group consisting of Ni, Co, Ir, Au, Pd, Cu and combinations thereof. In some embodiments, Ni in particular is used. These metallic elements promote the corrosion of the alloy. In all embodiments, the alloy particularly comprises the element selected from the group consisting of Ni, Co, Ir, Au, Pd, Cu and combinations thereof, more particularly Ni, in an amount of between 0.01% and 15% by weight (wt %), and in some embodiments more particularly between 0.1% and 10% by weight, even more particularly between 0.2% by weight and 8% by weight.

In all aspects, features and embodiments of this disclosure it is noted that an alternative corrosion promoting metallic element may be iron (Fe) in an amount of 0.01-10 wt %. The iron as an alternative corrosion promoting element may be used alone or with at least one of the corrosion promoting elements listed in this disclosure in a total amount of 0.01-10 wt %. However, iron would be an additive, not part of the alloy per se, as it would be present in suspension with other elements of the magnesium alloy.

Particular combinations of metals in the magnesium alloy include Mg—Al—Zn—Mn, Mg—Al—Mn, Mg—Zn—Zr, Mg—Zn—Cu—Mn, Mg—Al—Ca—Mn and Mg—Al—Sn—Zn—Mn. These additional elements can be included by forming an alloy of magnesium with those elements, and then adding a corrosion promoting metallic element (i.e., an element selected from the group consisting of Ni, Co, Ir, Au, Pd, Cu and combinations thereof) to the molten alloy.

For all embodiments, aspects and specific features of the disclosure, for example, the remainder of the alloy can be magnesium and incidental impurities. In particular, the content of Mg in the magnesium alloy is at least 80 wt %, more particularly at least 85 wt %, even more particularly at least 87 wt %.

In a first embodiment, the magnesium alloy comprises (a) 0.01-10 wt % of an element selected from the group consisting of Ni, Co, Ir, Au, Pd, Cu and combinations thereof, (b) 1-15 wt % Al, (c) 0.1-1 wt % Mn, and (d) optionally at least one of Ca, Sn and Zn.

In the first embodiment, the magnesium alloy comprises 1-15 wt % Al, particularly 2-12 wt % Al, more particularly 2.5-10 wt % Al.

In the first embodiment, the magnesium alloy comprises 0.1-1 wt % Mn, particularly 0.1-0.8 wt % Mn, more particularly 0.2-0.6 wt % Mn.

In the first embodiment, the magnesium alloy optionally comprises at least one of Ca, Sn and Zn. When the alloy comprises Sn, it is particularly in an amount of 2-6 wt %, more particularly 3-5 wt %. When the alloy comprises Zn, it is particularly in an amount of 0.1-3 wt %, more particularly 0.2-2.5 wt %. In some embodiments, the alloy comprises both Sn and Zn. When the alloy comprises Ca, it is particularly in an amount of 1-10 wt %, more particularly 2-6 wt %.

In the first embodiment, in particular the magnesium alloy comprises Ni in an amount of between 0.01% and 10% by weight, more particularly between 0.01% and 5% by weight, even more particularly between 0.1% by weight and 3% by weight.

In a second embodiment, the magnesium alloy comprises (a) 0.01-15 wt % of an element selected from the group consisting of Ni, Co, Ir, Au, Pd, Cu and combinations thereof, (b) 1-9 wt % Zn, and (c) optionally at least one of Mn and Zr.

In the second embodiment, the magnesium alloy comprises 1-9 wt % Zn, particularly 5-8 wt % Zn, more particularly 6-7 wt % Zn.

In the second embodiment, when the alloy comprises Mn it is particularly in an amount of 0.1-1 wt %, more particularly 0.5-1.0 wt %, even more particularly 0.7-0.9 wt %.

In the second embodiment, the magnesium alloy particularly comprises Ni in an amount of between 0.01% and 10% by weight, more particularly between 0.01% and 7% by weight, even more particularly between 0.1% by weight and 5% by weight.

In the second embodiment, the magnesium alloy may also comprise Cu, particularly in an amount of 0.1-5 wt %, more particularly 0.5-3 wt %, even more particularly 1-2 wt %. In some embodiments, the alloy comprises both Mn and Cu.

In the second embodiment, when the magnesium alloy comprises Zr it is particularly in an amount of up to 1 wt %, more particularly in an amount of 0.05-1.0 wt %, even more particularly in an amount of 0.2-1.0 wt %, more particularly in an amount of 0.3-0.7 wt %.

In particular the corrosion promoting metallic element (i.e., an element selected from the group consisting of Ni, Co, Ir, Au, Pd, Cu and combinations thereof) has a solubility of at least 0.1% by weight in molten magnesium at 850° C. More specifically, the corrosion promoting metallic element has a solubility of at least 0.5% by weight in molten magnesium at 850° C., more particularly at least 1% by weight. In some embodiments, in particular, the corrosion promoting metallic element has a solubility of at least 1% by weight in the molten magnesium alloy to which it is to be added at 850° C. In relation to the molten material, the term "solubility" is used to mean that the corrosion promoting metallic element dissolves in the molten magnesium or magnesium alloy.

More specifically, the corrosion promoting metallic element has a solubility of less than 0.1% by weight, more particularly less than 0.01% by weight, in solid magnesium at 25° C. In some embodiments, in particular the corrosion promoting metallic element has a solubility of less than 0.1% by weight, more particularly less than 0.01% by weight, in the solid magnesium alloy to which it is to be added at 25° C. In relation to the solid material, the term "solubility" is used to mean that atoms of the corrosion promoting metallic element are randomly distributed throughout the alloy in a single phase (i.e., rather than forming a separate phase).

More specifically, the magnesium alloy has a corrosion rate of at least 50 mg/cm$^2$/day, particularly at least 75 mg/cm$^2$/day, even more particularly at least 100 mg/cm$^2$/day, in 3% KCl at 38° C. (100° F.). In particular the magnesium alloy has a corrosion rate of at least 75 mg/cm$^2$/day, particularly at least 250 mg/cm$^2$/day, even more particularly at least 500 mg/cm$^2$/day, in 15% KCl at 93° C. (200° F.). In particular the corrosion rate, in 3% KCl at 38° C. or in 15% KCl at 93° C. (200° F.), is less than 15,000 mg/cm$^2$/day.

In particular the magnesium alloy has a 0.2% proof strength of at least 75 MPa, more particularly at least 100 MPa, even more particularly at least 150 MPa, when tested using standard tensile test method ASTM B557-10. In particular the 0.2% proof strength is less than 700 MPa. The proof strength of a material is the stress at which material strain changes from elastic deformation to plastic deformation, causing the material to deform permanently.

In particular the 0.2% proof strength of the magnesium alloy when the element selected from the group consisting of Ni, Co, Ir, Au, Pd, Cu and combinations thereof has been added is at least 80%, more particularly at least 90%, of the 0.2% proof strength of the base alloy. The term "base alloy" is used to mean the magnesium alloy without the element selected from the group consisting of Ni, Co, Ir, Au, Pd, Cu and combinations thereof, having been added. Even more particularly, the 0.2% proof strength of the magnesium alloy when Ni has been added is at least 80%, more particularly at least 90%, of the 0.2% proof strength of the base alloy.

This disclosure also relates to a corrodible downhole article, such as a downhole tool, comprising the magnesium alloy described above. For example, the corrodible downhole article can be a fracking ball, plug, packer or tool assembly. More specifically, the fracking ball can be substantially spherical in shape. In some embodiments, the fracking ball consists essentially of the magnesium alloy described above.

This disclosure also relates to a method for producing a magnesium alloy suitable for use as a corrodible downhole article comprising the steps of:

(a) melting magnesium or the magnesium alloy described above, (b) adding the element selected from the group consisting of Ni, Co, Ir, Au, Pd, Cu and combinations thereof to the molten magnesium or magnesium alloy such that the element selected from the group consisting of Ni, Co, Ir, Au, Pd, Cu and combinations thereof melts, (c) mixing the resulting molten magnesium alloy, and (d) casting the magnesium alloy.

In particular the method is for producing a magnesium alloy as defined above. In particular the melting step is carried out at a temperature of 650° C. (i.e., the melting point of pure magnesium) or more, particularly less than 1090° C. (the boiling point of pure magnesium). A particular temperature range is 650° C. to 850° C., more particularly 700° C. to 800° C., most specifically about 750° C.

The casting step normally involves pouring the molten magnesium alloy into a mould, and then allowing it to cool and solidify. The mould may be a die mould, a permanent mould, a sand mould, an investment mould, a direct chill casting (DC) mould, or other mould.

After step (c), the method may comprise one or more of the following additional steps: (d) extruding, (e) forging, (f) rolling, (g) machining In particular step (a) comprises melting the magnesium alloy described above. Specifically the magnesium alloy of step (a) comprises an element selected from the group consisting of Al, Zn, Mn, Zr, Cu, Ca, Sn, Ag and combinations thereof. Particular magnesium alloys for step (a) are selected from the group consisting of Mg—Al—Zn—Mn, Mg—Al—Mn, Mg—Zn—Zr, Mg—Zn—Cu—Mn, Mg—Al—Ca—Mn and Mg—Al—Sn—Zn—Mn. As noted above, these additional elements can be included by forming an alloy of magnesium with those elements, and then adding the corrosion promoting metallic element to the molten alloy.

In a first particular embodiment, the magnesium alloy comprises 1-15 wt % Al and up to 2 wt % in total of Zn and/or Mn. The alloy particularly comprises 2-12 wt % Al. In particular, the alloy comprises 0.2-1.2 wt % in total of Zn and/or Mn. In particular Ni is added in an amount of 0.1-3 wt %.

In a second particular embodiment, the magnesium alloy comprises 1-9 wt % Zn and optionally at least one of Mn and Zr. The alloy particularly comprises 5-8 wt % Zn. In particular Ni is added in an amount of 0.1-5 wt %.

In particular the corrosion promoting metallic element (i.e., Ni, Co, Ir, Au, Pd and/or Cu) has a solubility of at least 0.1% by weight in molten magnesium at 850° C. Particularly, the corrosion promoting metallic element has a solubility of at least 0.5% by weight in molten magnesium at 850° C., more particularly at least 1% by weight. In some embodiments, in particular the corrosion promoting metallic element has a solubility of at least 1% by weight in the molten magnesium or magnesium alloy to which it is added.

More specifically the corrosion promoting metallic element (i.e., an element selected from the group consisting of Ni, Co, Ir, Au, Pd, Cu and combinations thereof) has a solubility of less than 0.1% by weight, more particularly less than 0.01% by weight, in solid magnesium at 25° C. In some embodiments, in particular the corrosion promoting metallic element has a solubility of less than 0.1% by weight, more particularly less than 0.01% by weight, in the molten magnesium or magnesium alloy to which it is added once it has been cooled to 25° C. and solidified.

The corrosion promoting metallic element is selected from the group consisting of Ni, Co, Ir, Au, Pd, Cu and combinations thereof. In some embodiments, Ni in particular is used. In relation to compositions of the first particular embodiment, the corrosion promoting metallic element is particularly added in an amount of between 0.01% and 15% by weight, more particularly between 0.01% and 5% by weight, even more particularly between 0.1% and 3% by weight. In relation to compositions of the second particular embodiment, the corrosion promoting metallic element is particularly added in an amount of between 0.01% and 10% by weight, more particularly 0.01% and 7% by weight, even more particularly between 0.1% and 5% by weight.

This disclosure also relates to a magnesium alloy suitable for use as a corrodible downhole article which is obtainable by the method described above.

In addition, this disclosure relates to a magnesium alloy as described above for use as a corrodible downhole article.

In all aspects and embodiments of the disclosure, the magnesium alloy has a desired corrosion rate in 15% KCl at 93° C. selected from the group consisting of: 50-100 $mg/cm^2/day$; 100-250 $mg/cm^2/day$; 250-500 $mg/cm^2/day$; 500-1000 $mg/cm^2/day$; 1000-3000 $mg/cm^2/day$; 3000-4000 $mg/cm^2/day$; 4000-5000 $mg/cm^2/day$; 5000-10,000 $mg/cm^2/day$; 10,000-15,000 $mg/cm^2/day$ and combinations thereof.

The method of the disclosure comprises tailoring compositions of the magnesium alloys such that the cast magnesium alloys achieve desired corrosion rates in 15% KCl at 93° C. falling in at least two of the following ranges: 50 to 100 $mg/cm^2/day$; 100-250 $mg/cm^2/day$; 250-500 $mg/cm^2/day$; 500-1000 $mg/cm^2/day$; 1000-3000 $mg/cm^2/day$; 3000-4000 $mg/cm^2/day$; 4000-5000 $mg/cm^2/day$; 5000-10,000 $mg/cm^2/day$; and 10,000-15,000 $mg/cm^2/day$.

This disclosure also relates to a method of hydraulic fracturing comprising the use of a corrodible downhole article comprising the magnesium alloy as described above, or a downhole tool as described above. Particularly, the method comprises forming an at least partial seal in a borehole with the corrodible downhole article and then removing the at least partial seal by permitting the corrodible downhole article to corrode. This corrosion can occur at a desired rate with certain alloy compositions of the disclosure as discussed above in connection with the magnesium alloy of the present aspects and embodiments. More specifically, the corrodible downhole article can be a fracking ball, plug, packer or tool assembly. In particular, the fracking ball can be substantially spherical in shape. In some embodiments, the fracking ball consists essentially of the magnesium alloy described above.

BRIEF DESCRIPTION OF THE DRAWINGS

This disclosure will be further described by reference to the following Figures which is not intended to limit the scope of the claimed subject matter, in which:

EXAMPLES

Example 1

Magnesium Aluminium Alloy

A base magnesium alloy consisting of the commercial alloy AZ80A which has a typical chemical composition of 8.5 wt % Al, 0.5 wt % Zn and 0.3 wt % Mn, was melted by heating to 750° C. and nickel was added to it in amounts ranging between 0.01% wt to 1% wt. The product was then cast into a billet and extruded into a rod.

In order to simulate the mild and extreme corrosion performance in a well, the material was corrosion tested by measuring weight loss in an aqueous solution of 3 wt % potassium chloride at a constant temperature of 38° C. (100° F.) and 15 wt % potassium chloride aqueous solution at a constant temperature of 93° C. (200° F.).

The corrosion rates are shown in Table 1 below. The samples comprise the standard alloy (ie AZ80A without nickel added), and two samples with different amounts of nickel added.

TABLE 1

| Sample ID | Nickel concentration Wt % | Corrosion rate in 3% KCL at 38° C. (100° F.) Mg/cm$^2$/day | Corrosion rate in 15% KCL at 93° C. (200° F.) Mg/cm$^2$/day |
|---|---|---|---|
| Standard alloy | <0.005 | <0.5 | <0.5 |
| DF9905B | 0.016 | 113 | 449 |
| DF9905D | 0.61 | 161 | 1328 |

The data in Table 1 clearly shows the increased corrosion level achieved in the samples to which nickel has been added, with a higher nickel content resulting in a higher corrosion rate.

The mechanical properties of the samples were also tested using standardised tension tests (ie ASTM B557-10), and the results are shown in Table 2 below.

TABLE 2

| Sample ID | Nickel concentration Wt % | 0.2% Proof Strength MPa | UTS MPa | Elongation % |
|---|---|---|---|---|
| Standard alloy | <0.005 | 219 | 339 | 9 |
| DF9905B | 0.016 | 238 | 334 | 11 |
| DF9905D | 0.61 | 219 | 309 | 14 |

Figure 1:
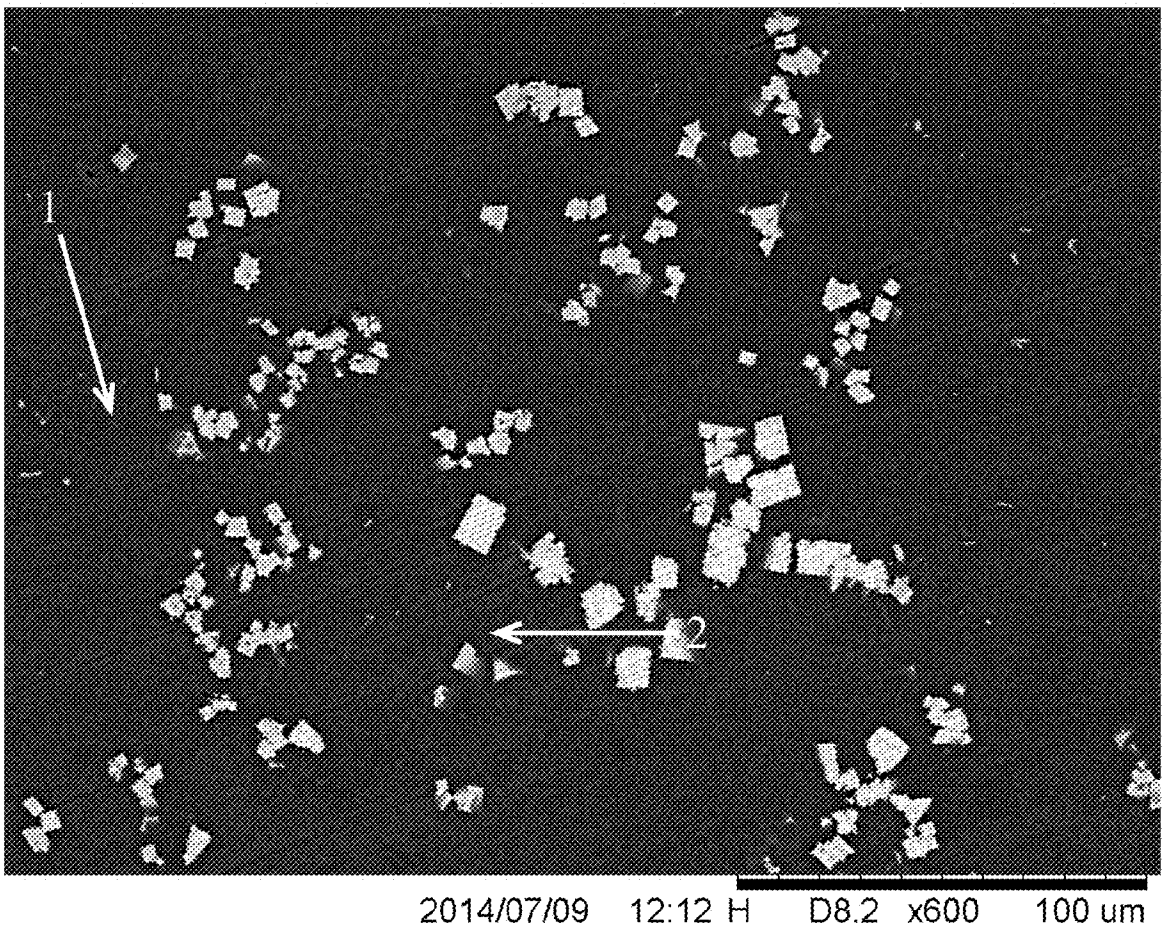
FIG. 1 shows a microstructure of sample DF9905D of Example 1.

FIG. 1 shows a microstructure of sample DF9905D (i.e., 0.61 wt % nickel). The dark area of the microstructure, labelled "1", is the α-Mg phase (i.e., the phase comprising magnesium in solid solution with the other alloying elements). The light area of the microstructure, an example of which is labelled "2", is the phase comprising the corrosion promoting element (i.e., nickel in this case) and magnesium.

Example 2

Magnesium Aluminium Alloys

Further magnesium alloy compositions were prepared by combining the components in the amounts listed in Table 3 below (the balance being magnesium). These compositions were then melted by heating at 750° C. The product was then cast into a billet and extruded to a rod.

TABLE 3

| Mg—Al | Alloy Additions (wt %, balance magnesium) | | | | | |
|---|---|---|---|---|---|---|
| Sample ID | Al | Ca | Sn | Zn | Mn | Ni |
| A1 | 8.4 | | | 0.4 | 0.2 | 0.00 |
| A2 | 8.4 | | | 0.4 | 0.2 | 0.02 |
| A3 | 8.4 | | | 0.4 | 0.2 | 0.15 |
| A4 | 8.4 | | | 0.4 | 0.2 | 1.50 |
| A5 | 6.5 | | | 0.7 | 0.3 | 0.00 |
| A6 | 6.5 | | | 0.7 | 0.3 | 0.05 |
| A7 | 6.5 | | | 0.7 | 0.3 | 0.15 |
| A8 | 6.5 | | | 0.7 | 0.3 | 0.30 |
| A9 | 6.5 | | | 0.7 | 0.3 | 0.60 |
| A10 | 6.5 | | | 0.7 | 0.3 | 1.20 |
| A11 | 3.0 | | | 0.7 | 0.3 | 0.00 |
| A12 | 3.0 | | | 0.7 | 0.3 | 0.05 |
| A13 | 3.0 | | | 0.7 | 0.3 | 0.15 |
| A14 | 3.0 | | | 0.7 | 0.3 | 0.30 |
| A15 | 3.0 | | | 0.7 | 0.3 | 0.60 |
| A16 | 3.0 | | | 0.7 | 0.3 | 1.20 |
| A17 | 3.5 | 3.0 | | 0.0 | 0.3 | 0.00 |
| A18 | 4.0 | 5.0 | | 0.0 | 0.5 | 0.15 |
| A19 | 4.0 | 3.6 | | 0.0 | 0.4 | 0.50 |
| A20 | 3.5 | 3.0 | | 0.0 | 0.3 | 2.00 |
| A21 | 8.0 | | 4.0 | 2.0 | 0.3 | 0.00 |
| A22 | 8.0 | | 4.0 | 2.0 | 0.3 | 0.15 |

The mechanical properties of these samples were also tested using the same standardised tension tests, and the results are shown in Table 4 below.

TABLE 4

| Alloy class: Mg—Al | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| A1 | 219 | 100 | 0 |
| A2 | 239 | 109 | 449 |
| A3 | 235 | 107 | 1995 |
| A4 | 220 | 101 | 1328 |
| A5 | 199 | 100 | 0 |

TABLE 4-continued

| Alloy class: Mg—Al | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| A6 | 197 | 99 | 2078 |
| A7 | 203 | 102 | 2531 |
| A8 | 198 | 99 | 2800 |
| A9 | 197 | 99 | 2574 |
| A10 | 199 | 100 | 2494 |
| A11 | 211 | 100 | 0 |
| A12 | 196 | 93 | 1483 |
| A13 | 192 | 91 | 1853 |
| A14 | 194 | 92 | 1854 |
| A15 | 197 | 94 | 1969 |
| A16 | 194 | 92 | 1877 |
| A17 | 321 | 100 | 0 |
| A18 | 329 | 102 | 3299 |
| A19 | 312 | 97 | 4851 |
| A20 | 309 | 96 | 2828 |
| A21 | 258 | 100 | 0 |
| A22 | 256 | 99 | 1205 |

This data shows that the addition of nickel to these magnesium-aluminium alloys significantly increases the corrosion rate of the alloys. Advantageously, for these alloys this increase in corrosion rate is provided whilst maintaining the mechanical properties of the alloy (as exemplified by the 0.2% proof strength). Thus, the alloys tested in this example can find use as components in downhole tools due to their combination of high corrosion rates and good mechanical properties.

Example 3

Magnesium Zinc Alloys

Magnesium alloy compositions were prepared by combining the components in the amounts listed in Table 5 below. These compositions were then melted by heating at 750° C. The product was then cast into a billet and extruded to a rod.

TABLE 5

| Mg—Zn | Alloy Additions (wt %, balance Mg) | | | | |
|---|---|---|---|---|---|
| Sample ID | Zn | Cu | Mn | Zr | Ni |
| Z1 | 6.5 | 1.5 | 0.8 | | 0.00 |
| Z2 | 6.5 | 1.5 | 0.8 | | 1.00 |
| Z3 | 6.5 | 1.5 | 0.8 | | 2.00 |
| Z4 | 6.5 | 1.5 | 0.8 | | 4.00 |
| Z5 | 6.5 | | | 0.5 | 0.00 |
| Z6 | 6.5 | | | | 0.15 |
| Z7 | 6.5 | | | | 0.30 |
| Z8 | 6.5 | | | | 1.00 |

The mechanical properties of these samples were tested using standardised tension tests, and the results are shown in Table 6 below.

TABLE 6

| Alloy Class: Mg—Zn | | | |
|---|---|---|---|
| Sample ID | 0.2% Proof Strength (MPa) | Percentage Proof Strength remaining (%) | Corrosion Rate in 15% KCl at 93° C. (200° F.) (mg/cm$^2$/day) |
| Z1 | 312 | 100 | 50 |
| Z2 | 229 | 73 | 315 |
| Z3 | 229 | 73 | 5474 |
| Z4 | 216 | 69 | 9312 |
| Z5 | 223 | 100 | 1 |
| Z6 | 133 | 59 | 565 |
| Z7 | 137 | 62 | 643 |
| Z8 | 142 | 63 | 905 |

This data shows that the addition of nickel to these magnesium-aluminium alloys advantageously significantly increases their corrosion rate. Magnesium-zinc alloys are known in the art to have high strength values and it is shown in the disclosure that the addition of nickel also increases their corrosion rate. However, the data demonstrates that the mechanical properties of these Magnesium-zinc alloys (as exemplified by the 0.2% proof strength) decrease with increasing nickel content.

This example shows that not all magnesium alloys provide the mechanical strength required for certain uses of the disclosure when nickel is added to them, and that it is in fact difficult to predict how the properties of a particular alloy will be altered when a corrosion promoting element such as nickel is added.

Figure 2:
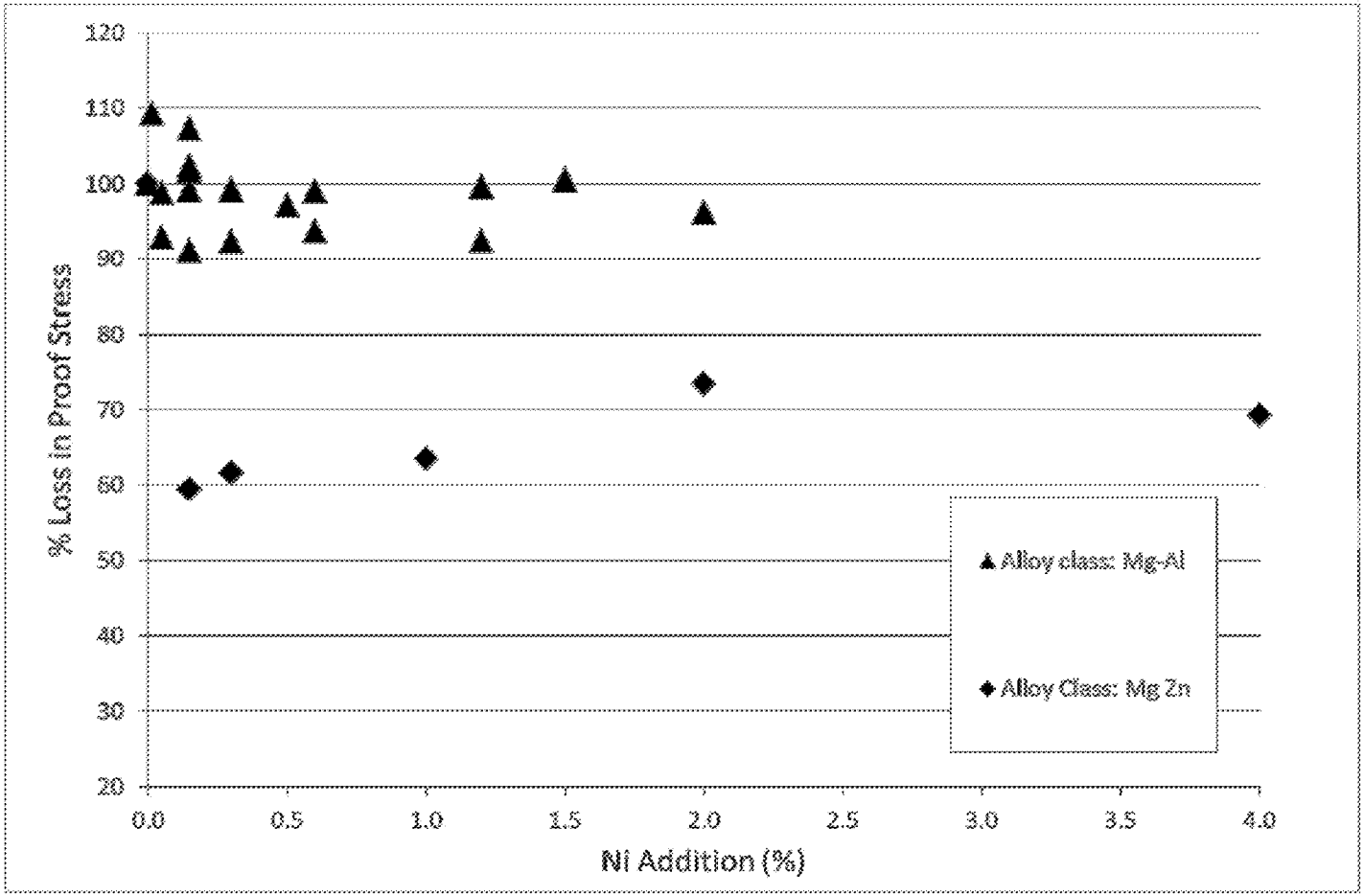
FIG. 2 shows a graph of % loss in proof stress against Ni addition (wt %) for the alloys of Examples 2 and 3.
Figure 3:
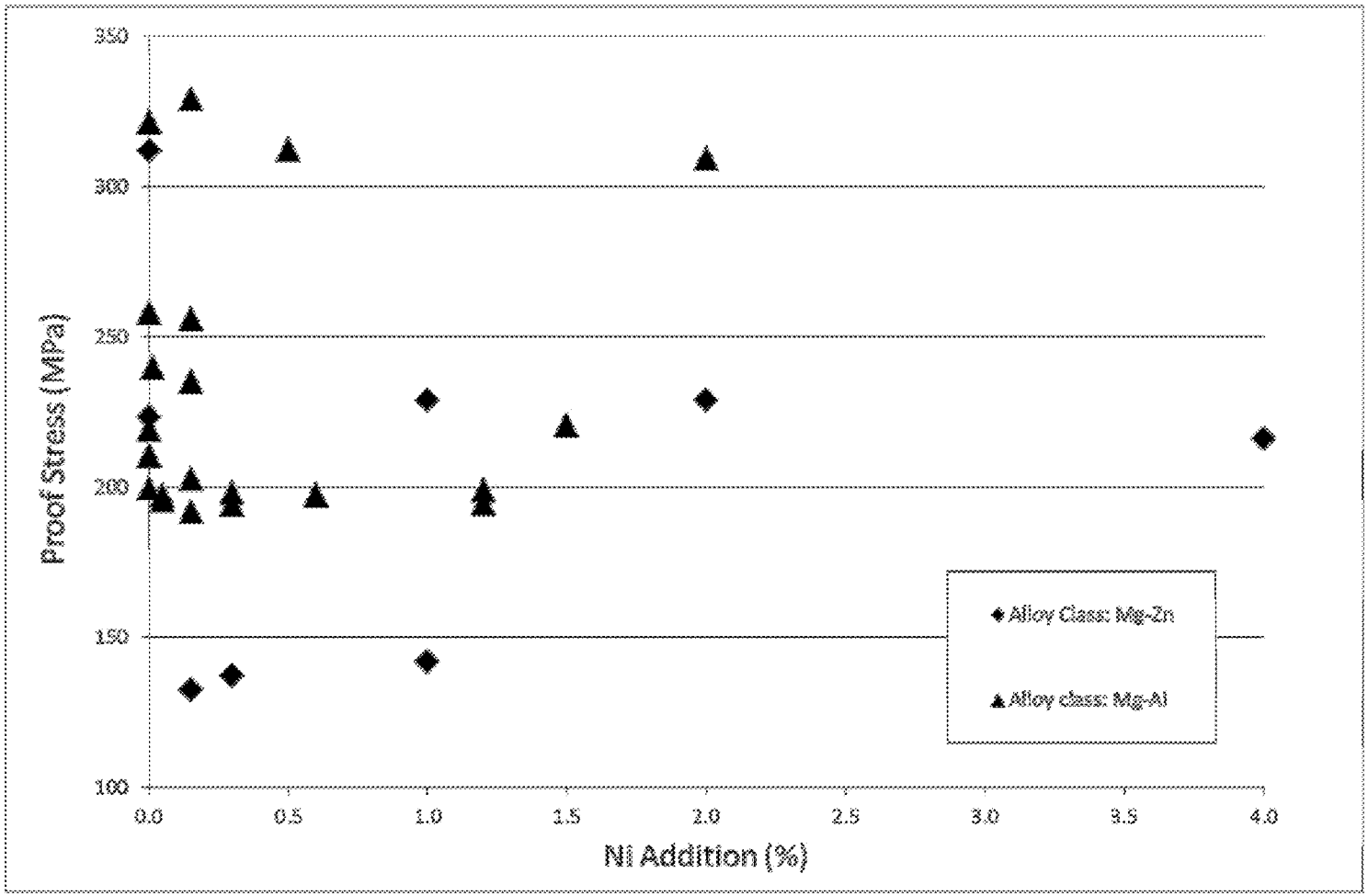
FIG. 3 shows a graph of proof stress against Ni addition (wt %) for the alloys of Examples 2 and 3.

In FIGS. 2 and 3 the mechanical properties of the alloys of Examples 2 and 3, have been plotted against the Ni addition (wt %).

FIG. 2 in particular shows that for the magnesium-zinc alloys of Example 3 ("Mg—Zn", where zinc is the major strengthening element), between 20% and 40% of the strength is lost when nickel is added. In contrast, the strength of the magnesium-aluminium ("Mg—Al") alloy (Example 2) is maintained. FIG. 3 is a plot showing the absolute proof strength values (MPa) against Ni addition (wt %).

Figure 4:
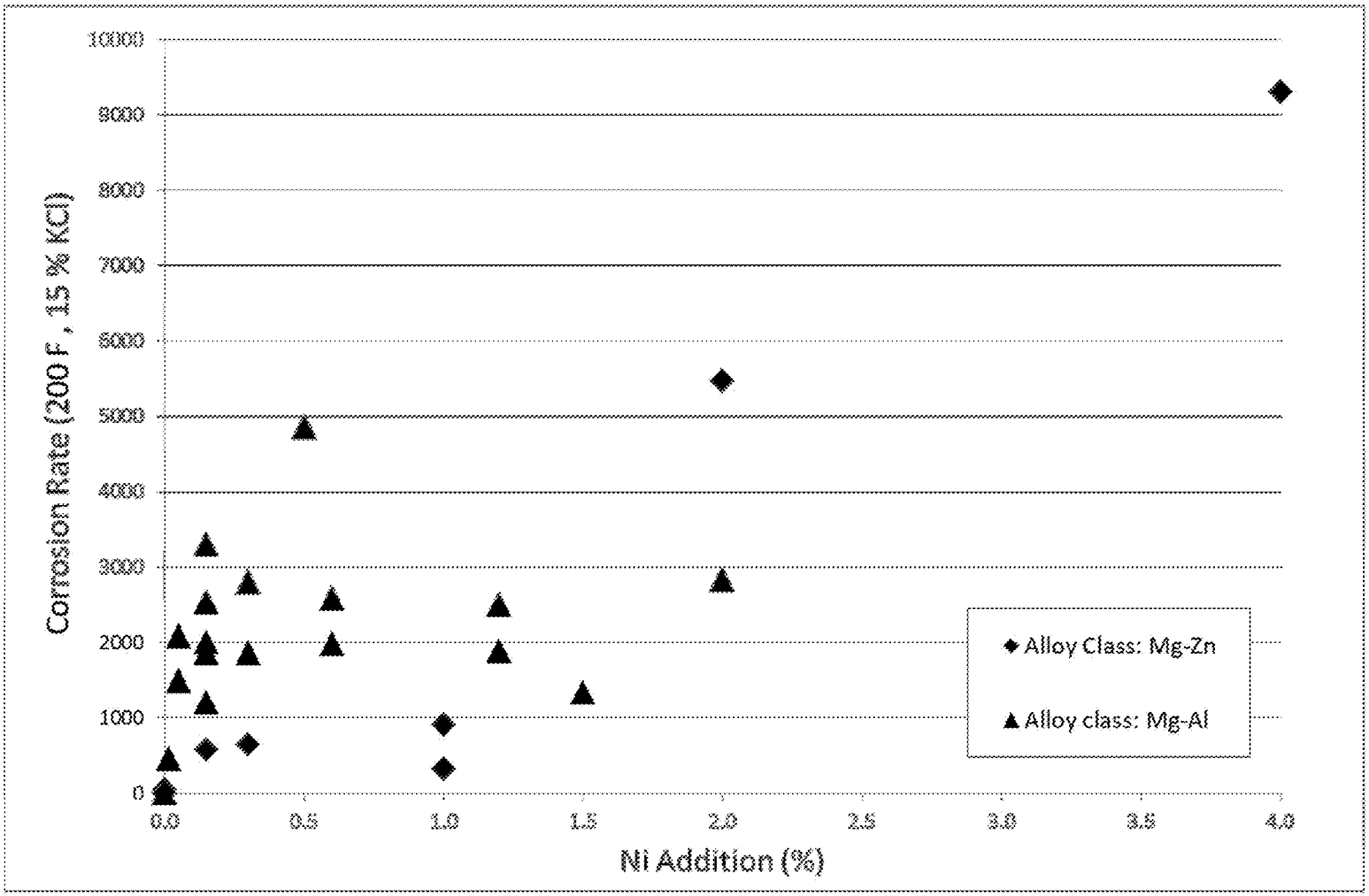
FIG. 4 shows a graph of corrosion rate against Ni addition (wt %) for the alloys of Examples 2 and 3.

FIG. 4 is a plot of corrosion rate against Ni addition (wt %).

Many modifications and variations of the disclosed subject matter will be apparent to those of ordinary skill in the art in light of the foregoing disclosure. Therefore, it is to be understood that, within the scope of the appended claims, the invention can be practiced otherwise than has been specifically shown and described.

What is claimed is:

1. A corrodible downhole article comprising a magnesium alloy, the magnesium alloy comprising the following elements:

1-9 wt % Zn;

1-2 wt % Cu;

0.5-1.0 wt % Mn; and 0.1-5 wt % of a corrosion promoting element, and being essentially free of aluminum, wherein the remainder is magnesium and incidental impurities, wherein said magnesium alloy has a microstructure resulting from said Zn, Cu, Mn, corrosion promoting element and magnesium being melted at a temperature of at least the melting point of magnesium, mixed and resolidified, said microstructure including predominantly a first phase, said first phase including the magnesium in solid solution with the other elements, and a second phase including the corrosion promoting element and magnesium;

wherein said magnesium alloy is adapted to degrade by microgalvanic corrosion in aqueous electrolyte.

2. The corrodible downhole article of claim 1 wherein said corrosion promoting element includes Ni.

3. The corrodible downhole article of claim 1 including 5-8 wt % Zn.

4. The corrodible downhole article of claim 1 wherein the corrodible downhole article is a downhole tool.

5. A method comprising placing said downhole tool of claim 4 in a borehole, using said corrodible downhole tool in said borehole and then permitting said corrodible downhole tool to corrode in said borehole.

6. The corrodible downhole article of claim 1 wherein the alloy has a 0.2% proof strength of at least 150 MPa when tested using standard tensile test method ASTM B557-10.

7. A method for producing the corrodible downhole article of claim 1 comprising the steps of:

melting a composition including Zn, Cu, Mn, corrosion promoting element, and wherein the remainder is magnesium and incidental impurities, at a temperature of at least the melting point of magnesium, wherein the composition comprises:

1-9 wt % Zn;

1-2 wt % Cu;

0.5-1.0 wt % Mn;

0.1-5 wt % of the corrosion promoting element, and being essentially free of aluminum, wherein the remainder is magnesium and incidental impurities, mixing the composition and forming a magnesium alloy, and casting and solidifying the magnesium alloy to form the corrodible downhole article.

8. The method of claim 7 wherein said casting of said magnesium alloy occurs in a mold without compression of said magnesium alloy.

9. A corrodible downhole article comprising a magnesium alloy, the magnesium alloy comprising:

1-9 wt % Zn;

1-2 wt % Cu;

0.5-1.0 wt % Mn;

0.1-5 wt % of a corrosion promoting element, and being essentially free of aluminum, wherein the remainder is magnesium and incidental impurities, with the proviso that said corrodible downhole article is not a powdered metal compact, wherein said magnesium alloy is adapted to corrode in freshwater so as to be removed from a borehole.

10. The corrodible downhole article of claim 9 wherein said corrosion promoting element includes Ni.

* * * * *